US005791435A

United States Patent [19]

Garnett

[11] Patent Number: 5,791,435

[45] Date of Patent: Aug. 11, 1998

[54] LADDER ETC. SUPPORT

[75] Inventor: William Garnett, Pontypridd, United Kingdom

[73] Assignee: Jacob's Ladder Bases Ltd., Pontypridd, United Kingdom

[21] Appl. No.: 505,235

[22] PCT Filed: Feb. 9, 1994

[86] PCT No.: PCT/GB94/00258

§ 371 Date: Aug. 14, 1995

§ 102(e) Date: Aug. 14, 1995

[87] PCT Pub. No.: WO94/18426

PCT Pub. Date: Aug. 18, 1994

[30] Foreign Application Priority Data

| | | | |
|---|---|---|---|
| Feb. 9, 1993 | [GB] | United Kingdom | 9302500 |
| Nov. 22, 1993 | [GB] | United Kingdom | 9323963 |

[51] Int. Cl.[6] ..... E06C 7/46

[52] U.S. Cl. ..... 182/107; 182/108; 248/910

[58] Field of Search ..... 182/107, 108, 182/200; 248/910

[56] References Cited

U.S. PATENT DOCUMENTS

| | | | |
|---|---|---|---|
| 2,956,287 | 10/1960 | Stanford | 248/910 X |
| 4,795,117 | 1/1989 | Siteman | 248/910 X |
| 4,964,600 | 10/1990 | Lee | 248/910 X |

FOREIGN PATENT DOCUMENTS

| | | |
|---|---|---|
| 462496 | 1/1946 | Belgium . |
| 564729 | 7/1960 | Belgium . |
| 0202368 | 11/1986 | European Pat. Off. . |
| 1194189 | 11/1959 | France . |
| 622680 | 5/1949 | United Kingdom . |
| 2156415 | 10/1985 | United Kingdom . |

*Primary Examiner*—Alvin C. Chin-Shue
*Attorney, Agent, or Firm*—Edwin D. Schindler

[57] ABSTRACT

A support comprising a flexible bag filled with sand and having a plate closing its top. An aperture is formed in the plate for receiving a foot of a ladder, the aperture being closed by a diaphragm.

7 Claims, 3 Drawing Sheets

LADDER ETC. SUPPORT

This invention relates to a support for a ladder or other generally upright object.

Ladders are inherently unstable, and many accidents are caused when the foot of the ladder slips or when the ladder falls sideways. These problems are exacerbated if the ladder is used on an uneven, sloping or slippery surface. other upright objects such as scaffolding, marquee and tent poles are similarly unstable if they are stood on uneven, sloping or slippery ground.

We have now devised a support which alleviates the above mentioned problems.

In accordance with this invention, there is provided a support for a ladder or other object, comprising a flexible bag filled with granular material, and a plate closing the top of the bag, the plate having an aperture in its upper surface for receiving a foot of a ladder or other generally upright object, the aperture being closed by a member able to move downwardly against the granular material when loaded by the foot of the ladder or other object.

In use, the bag adopts the shape of the ground. The downwards load on the foot of the ladder or other object applies a load to the granular material, which is thus urged outwardly against the inside of the bag and upwardly against the underside of the top of the bag, so that the support becomes rigid and provides a firm base for the ladder or other object.

Preferably the flexible diaphragm comprises elastomeric material. Preferably the diaphragm is attached to the underside of the plate along a line spaced outwardly from the perimeter of the aperture. The diaphragm may however be replaced by a rigid member arranged to displace downwardly against the granular material, when loaded by the foot of the ladder or other object.

Preferably the underside of the support is provided with a piece of material e.g. rubber to inhibit the bag slipping on the ground surface and also to protect the bag from being damaged.

Preferably the bag is attached around its neck to the plate.

Preferably the bag is formed from a material impermeable to water.

Preferably a strap encircles the bag and can be adjustably tightened to raise the height of the support, for example so that the two feet of a ladder can be supported in a level manner on sloping ground.

Preferably the granular material comprises sand.

Embodiments of this invention will now be described by way of examples only and with reference to the accompanying drawings, in which FIG. 1 is a perspective view of an embodiment of support in accordance with this invention;

Figure 1:
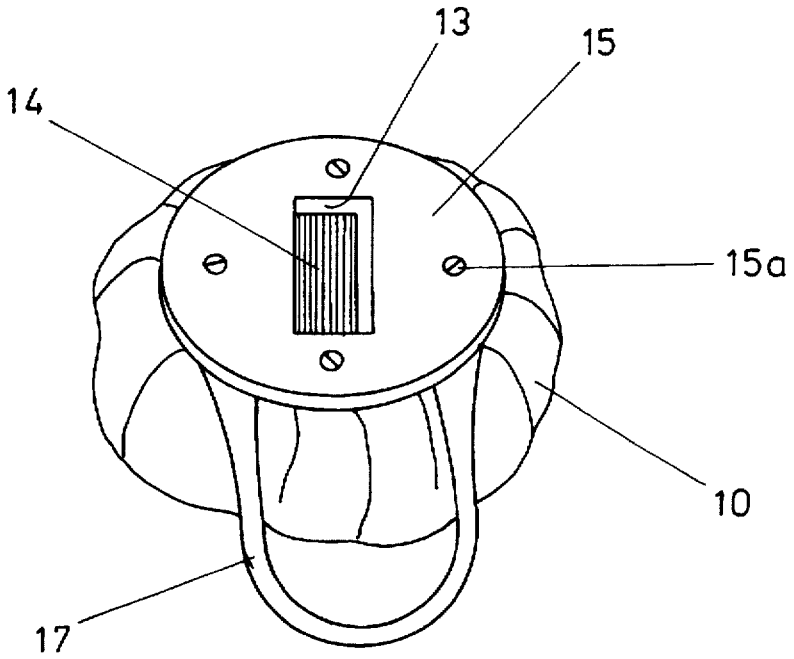
Figure 2:
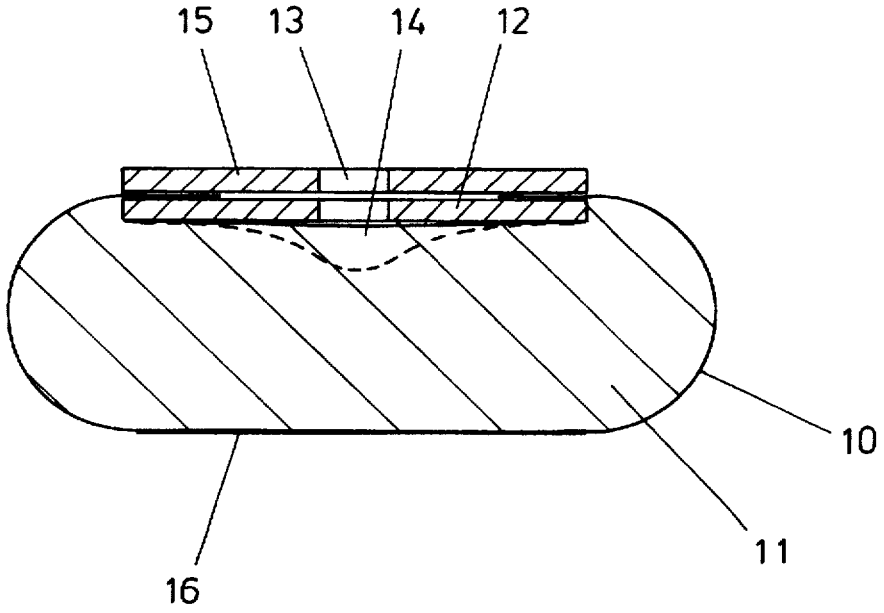
FIG. 2 is a sectional view through the support of FIG. 1.

Referring to FIGS. 1 and 2 of the drawings, there is shown a support comprising a flexible round bag 10 formed from a flat sheet of woven nylon material treated with a waterproofing compound: this material is impermeable to water, to prevent the inflow of water (which would be absorbed by sand filling the bag and so increase the weight of the support), but is able to "breath" so that moisture-laden air may flow outwards as well as inwards. The bag 10 is filled with sharp sand 11 and is secured around its neck, e.g. by stapling to the upper surface of a rigid circular plate 12, which may be of plastics material. A carrying handle 17, comprising a strip of flexible material, is attached at its opposite ends to the upper surface of the plate 12. A second plate 15 is fixed in face-to-face contact with the plate 12, e.g. by fastening studs 5*a*. A rectangular aperture 13 is formed through the two plates 12,15 and is closed by a flexible rubber diaphragm 14 which is attached (e.g. by stapling) to the underside of the plate 12, preferably along a line adjacent the periphery of the plate 12

A rubber pad 16 is attached to the underside of the bag 10 to inhibit the bag slipping on the ground surface and also to protect the bag against damage.

Figure 3:
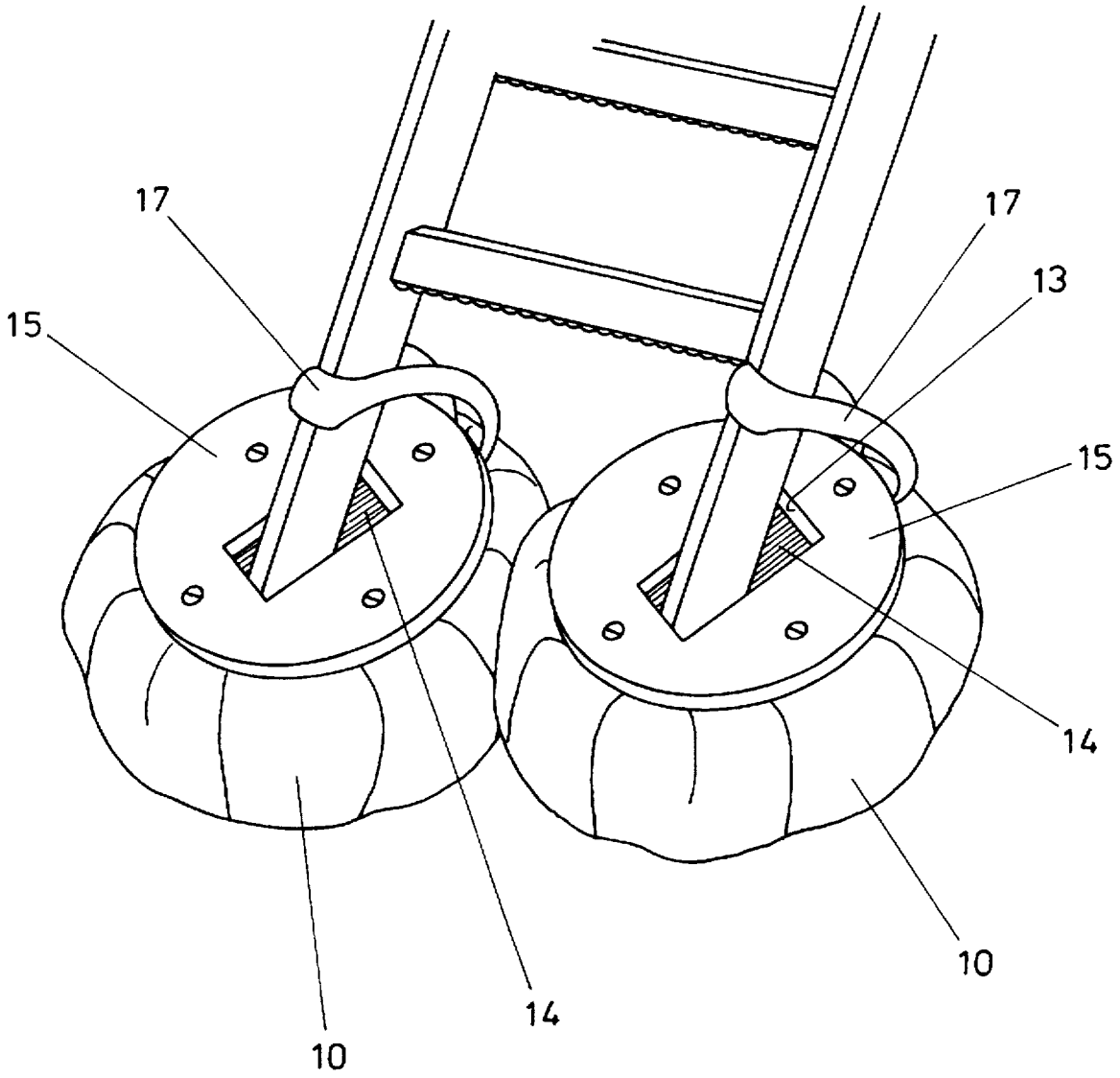
FIG. 3 is a perspective view of a pair of supports in use.

Referring to FIG. 3, a pair of the above-described supports may be placed side-by-side for receiving the feet of a ladder. The uprights of the ladder extend through the apertures 13 in the respective supports, and may also extend through the handles 17 as shown. The supports mould themselves to the shape of the ground. The feet of the ladder act, through the flexible diaphragms 14, to apply a load to the sand in the two bags: the sand is thus urged outwardly against the insides of the bags and upwardly against the undersides of the diaphragms 14, so that the two supports become rigid and provide a firm base for the ladder. In practice, the feet of the ladder displace the central regions of the diaphragms 14 downwardly through a substantial distance, typically 1 to 1½ inches (the depth of sand in an unloaded bag being typically 3 inches), to a position such as shown by the dotted line in FIG. 2. The upwards force exerted by the sand on the undersides of the diaphragms urges a peripheral margin of each diaphragm against the underside of the plate 12 and this helps to prevent the diaphragm being torn from its attachment to the plate 12. The rigid plates 12, 15 prevent the ladder from moving relative to the support, whilst the rubber pads 16 increase the friction between the supports and the ground to prevent slippage.

Preferably the diaphragms 14 are of elastomeric material, although instead the material may be flexible but non-elastic. Instead, the diaphragm may be replaced by a rigid member provided this member is able to displace downwardly under the loading of the ladder foot.

Figure 4:
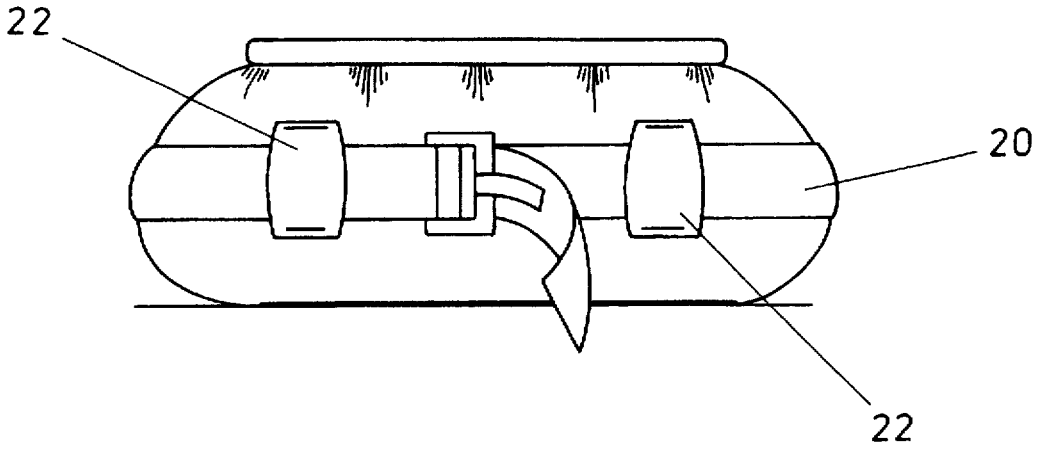
FIG. 4 is a side view of an alternative embodiment of support in accordance with this invention.
Figure 5:
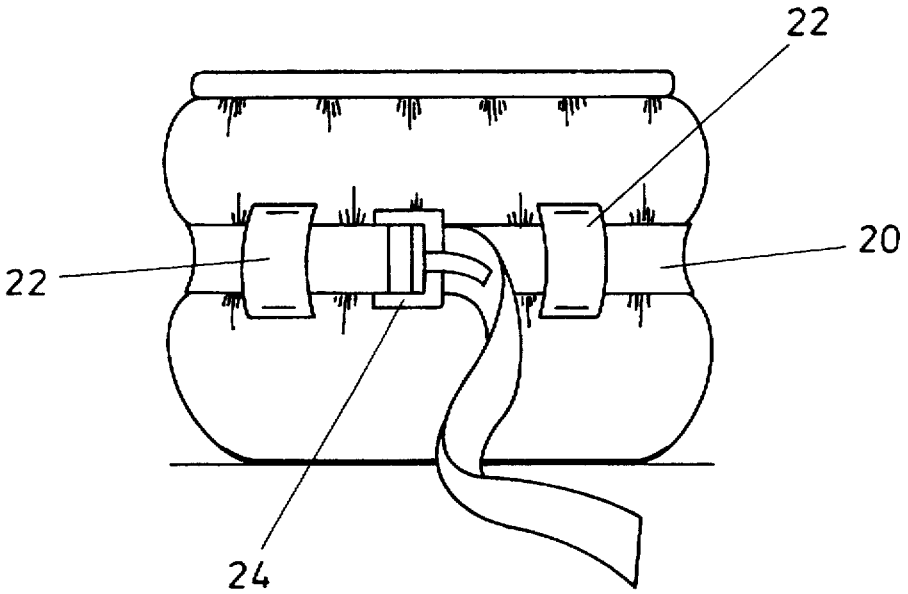
FIG. 5 is a side view of the support of FIG. 4, shown in its extended condition.

Referring to FIG. 4, one of the supports may comprise a strap 20 extending around the periphery of the bag 10 and retained by loops 22 attached to the bag at intervals. In use, the strap 20 may be tightened and its ends secured by a buckle 24 as shown in FIG. 5, to raise the height of the support. Thus, the supports may be used to support a ladder on a sloping ground surface, by adjusting the strap 20 to bring the level of the plates 12, 15 of the two supports substantially level.

Whilst the supports have been described for use in providing a firm base for a ladder, they may instead be used as a base for other objects, for example scaffold poles or tent or marquee poles: for these uses, the aperture 13 in the plates 12,15 of the support may be square or circular, for example, instead of being rectangular as shown.

What is claimed is:

1. A support for a ladder or other object, comprising a flexible bag partially filled with granular material and having a ground-engaging surface, and a plate closing the top of the bag, the plate having an aperture in its upper surface for receiving a foot of a ladder or other generally upright object, the aperture being closed by a flexible diaphragm able to move downwardly against the granular material when loaded by the foot of the ladder or other object.

2. A support as claimed in claim 1, provided on its underside with a piece of anti-slip material.

3. A support as claimed in claim 1, in which the bag is attached around its neck to the plate.

4. A support as claimed in claim 1, in which the bag is formed from a material impermeable to water.

5. A support as claimed in claim 1, in which the granular material comprises sand.

6. A support as claimed in claim 1, comprising a carrying handle.

7. A support as claimed in claim 1, comprising a strap encircling said bag and arranged for adjustably tightening.

* * * * *